United States Patent [19]

Nakanishi

[11] Patent Number: 5,030,964

[45] Date of Patent: Jul. 9, 1991

[54] TELESCOPIC ANTENNAS FOR USE IN VEHICLES

[75] Inventor: Takeshi Nakanishi, Tokyo, Japan

[73] Assignee: Harada Kogyo Kabushiki Kaisha, Tokyo, Japan

[21] Appl. No.: 442,018

[22] Filed: Nov. 28, 1989

[51] Int. Cl.[5] ..... H01Q 1/10; H01Q 1/32

[52] U.S. Cl. ..... 343/715; 343/901

[58] Field of Search ..... 343/702, 715; 393/888, 393/889, 900, 901

[56] References Cited

U.S. PATENT DOCUMENTS

| | | | |
|---|---|---|---|
| 2,170,684 | 8/1939 | Greenberg et al. | 343/715 |
| 2,850,305 | 9/1958 | Chadowski et al. | 343/715 |
| 2,861,268 | 11/1958 | Tinsley | 343/889 |

FOREIGN PATENT DOCUMENTS

| | | | |
|---|---|---|---|
| 0243017 | 10/1960 | Australia | 343/715 |

*Primary Examiner*—Rolf Hille
*Assistant Examiner*—Peter Toby Brown
*Attorney, Agent, or Firm*—Koda & Androlia

[57] ABSTRACT

A telescopic antenna for use in vehicles including an antenna element which has a cap on its tip and a removable locking element at its base, an antenna housing which is mounted to the vehicle body and has an insertion hole for removably housing the antenna element therein, and a fastener provided on the antenna element and screwed in to the antenna housing for fastening the antenna element thereto. When the fastener is unscrewed and the antenna element is removed from the antenna housing, the fastener can be removed from the antenna element after the locking projection is dismounted from the antenna element regardless of the size of the cap so that the fastener is reusable.

3 Claims, 1 Drawing Sheet

TELESCOPIC ANTENNAS FOR USE IN VEHICLES

BACKGROUND OF THE INVENTION

1. Field of the Invention

The present invention relates to a telescopic antenna for use in vehicles and more particularly to a telescopic automobile antenna in which a rod-form antenna element can be removed from outside of the vehicle.

2. Prior Art

Telescopic antennas used in vehicles generally have the following type of structure: A telescopic rod-form antenna element made up of a plurality of conductive rods of different diameters is housed in a housing tube mounted on a vehicle body wall so that the antenna element can be inserted into and removed from the housing tube. The conductive rods of the antenna element are slidable relative to each other. The housing tube has a stopper which prevents the rod-form antenna element from slipping out of the housing tube. In other words, when the rod-form antenna element reaches its extension limit, the stopper prevents further extension of the antenna so that the antenna element does not completely come out of the housing tube.

In this type of telescopic antenna, the rod-form antenna element and the housing tube are formed into a single integral unit; i.e., such an antenna is not constructed so that the rod-form antenna element alone may be taken out of the housing tube from outside of the vehicle body. Accordingly, when the rod-form antenna element breaks or suffers problems and needs to be replaced, the entire antenna housing tube (including the antenna element) must be removed from the vehicle body, exchanged for a new unit, and then installed from the inside of the vehicle body. Thus, replacement of the rod-form antenna element is complex and difficult, and quick and reliable antenna repair work becomes impossible.

In order to avoid such problems, an antenna in which the rod-form antenna element alone can be simply removed from outside of a vehicle has been developed. In this antenna, a rod-form antenna element which has a locking projection at the lower end is inserted into a housing tube (which is mounted to the vehicle body wall) through an antenna insertion hole which opens in the upper portion of the housing tube. The antenna element is inserted from outside of the vehicle body, and a fastening element which is a tubular bolt is then screwed into the insertion hole so that the fastening element prevents the locking projection from passing through the antenna insertion hole to outside of the vehicle body. Thus, the rod-form antenna element is prevented from falling out of the vehicle body when the antenna is in use.

According to this type of antenna, the rod-form antenna element alone can be replaced from outside of the vehicle body by unscrewing and screwing the fastening element. Therefore, it is advantageous in that the antenna element can be more efficiently replaced compared to other types of conventional antennas.

However, there are problems which still remain unsolved. A cap which acts both as an ornament and as a protective device is attached at the tip (top end) of the smallest diameter conductive rods (hereinafter called "smallest-diameter rod") which comprises the antenna element. The diameter of this cap is usually equal to or smaller than the diameter of the largest diameter conductive rod (called "largest-diameter rod").

The reason for the particular diameter size of the cap is as follows: When the rod-form antenna is removed from the housing tube to replace it with a new one, the fastening element which is fitted over the rod-form antenna element is also moved. Ordinarily, this fastening element does not suffer any damage and can be reused. Accordingly, it is not economical to discard the fastening element with the rod-form antenna element. In order to reuse this fastening element, it must be removed from the rod-form antenna element either from the base end of the antenna element or from the tip end thereof. However, since the locking projection is fastened to the base end of the antenna element, the fastening element is not removed from the base end. Thus, the diameter of the cap is equal or smaller than the diameter of the largest-diameter rod so that the fastening element can be removed from the tip end of the antenna element.

However, if the diameter of the cap is equal or smaller than the diameter of the largest-diameter rod, some inconveniences arise. That is, when the antenna is not in use and the rod-form antenna element is completely retracted inside the housing tube, a small gap remains between the edge of the antenna insertion opening of the housing tube and the largest-diameter rod. This gap can act as a point of ingress for rain water, dust, etc. Accordingly, the gap should be covered with a cap. However, if the cap is larger in diameter than the largest-diameter rod to cover the gap, it becomes impossible to remove the fastening element from the rod-form antenna element via the tip end thereof so as to replace it. Thus, in this case, reuse of the fastening element is not possible.

SUMMARY OF THE INVENTION

Accordingly, a primary object of the present invention is to provide a telescopic antenna for vehicles in which a rod-form antenna element itself can easily be removed from outside of the vehicle body for replacement.

Another object of the present invention is to provide a telescopic automobile antenna wherein a fastening element is easily removed from the rod-form antenna element even if the diameter of a cap at the tip end of the smallest-diameter rod is larger than the largest-diameter rod of the antenna element, making it possible to reuse the fastening element.

The objects of the present invention are accomplished by a unique structure for a telescopic automobile antenna which includes (a) a rod-form antenna element which has a cap at the tip and a locking projection at the base, (b) a housing tube which houses the rod-form antenna element so that it is removed therefrom and has an attachment base for mounting the housing tube to the vehicle body wall, (c) an antenna insertion hole formed in the housing tube so that the rod-form antenna element is removably set therein from outside of the vehicle, and (d) a fastening element provided on the antenna element and removably connected to the antenna insertion hole of the housing tube. The fastening element allows the rod-form antenna element to freely slide inside the antenna insertion hole during extension and retraction of the rod-form antenna element and prevents the locking projection from slipping out of the antenna insertion hole. The locking projection is detachable form the base of the rod-form antenna element by means of screws, etc.

With the above described structure, since the locking projection is detachable from the base of the rod-form antenna element, the fastening element can also be removed from the base end of the rod-form antenna element after the locking projection has been removed from the antenna element. Accordingly, even if the diameter of the cap at the tip of the smallest-diameter rod of the rod-form antenna is larger than the diameter of the largest-diameter rod, the fastening element can easily be removed from the antenna element and therefore reused.

DETAILED DESCRIPTION OF THE INVENTION

Figure 1:
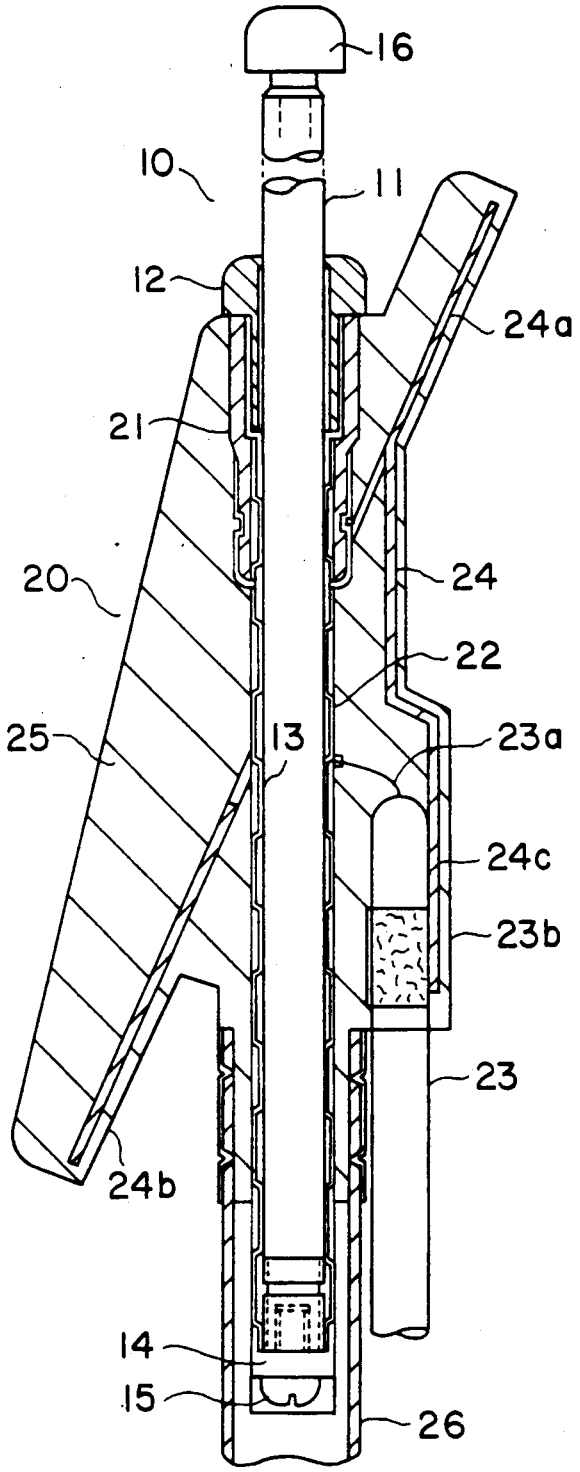
FIG. 1 is a cross sectional view of the overall structure of the telescopic antenna for use in vehicles provided by the present invention.
Figure 2:
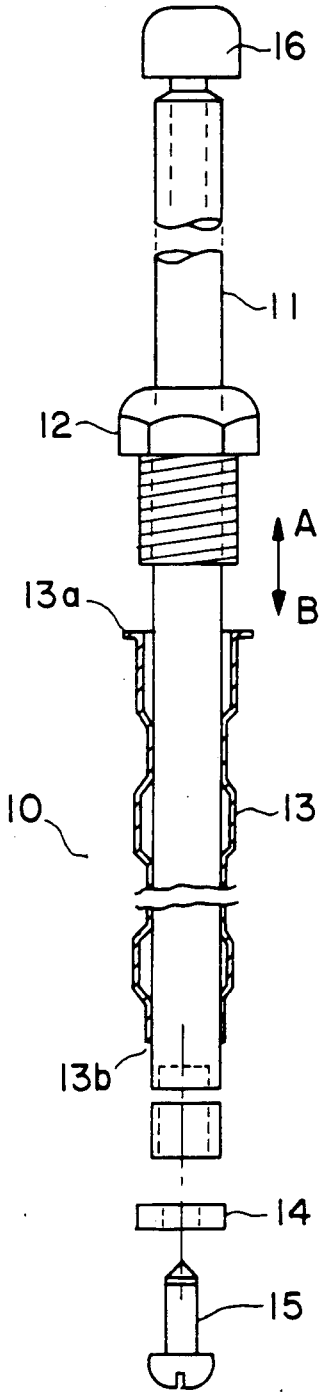
FIG. 2 is a partially exploded and cross-sectional side view of the antenna parts with the housing tube omitted.

In FIGS. 1 and 2, reference numeral 10 is a telescopic antenna, and 20 is a housing tube. A conductive contact spring 13 in FIG. 2 is shown exaggerated in thickness and degree of projection compared to the one shown in FIG. 1.

The telescopic antenna 10 includes a rod-form antenna element 11 which is formed by connecting a plurality of conductive rods of different diameters so that they are freely slidable.

A fastening element 12 (a tubular bolt) having an external thread on its shank portion and a conductive contact spring 13 made of an elastic metal material such as phosphorus, bronze, etc. are provided so that the fastening element 12 and the spring 13 are fitted over the largest diameter rod of the antenna element 11 in the order shown in FIG. 2.

A ring 14 which acts as a locking projection is fastened to the base end of the antenna element 11 via a screw 15 so that the ring 14 can be removed. A cap 16 which acts as both an ornament and a protective device is attached to the tip of the smallest-diameter rod of the antenna element 11.

The housing tube 20 houses the antenna element 11 so that the antenna element 11 is removable from the housing tube 20. An attachment base 25 for mounting the housing tube 20 to the vehicle body wall (not shown) is provided at the upper area of the housing tube 20. A tube 26 for housing the antenna element 11 is connected to the lower end of the housing tube 20.

The attachment base 25 of the housing tube 20 is molded into an integral unit with elements 21 through 24 (described below) using an insulating molding material such as synthetic resin, etc. As seen in FIG. 1, the attachment base 25 has inclined attachment surfaces which allow the telescopic antenna 10 to be positioned at a predetermined angle of inclination relative to the vehicle body wall.

An antenna insertion hole (not specifically referred to by a reference numeral in the drawings) opens at the center of the attachment base 25. This antenna insertion hole is formed so that the rod-form antenna element 11 is removably installed in the housing tube 20 from outside of the vehicle body.

A conductive tube 21 which is internally threaded is provided in the entry/exit area opening of the antenna insertion hole (or at the top end of the insertion hole), and a conductive tube 22 is also provided inside the antenna insertion hole so that the upper end of the conductive tube 22 is connected to the conductive tube 21.

A core wire **23*a* of a coaxial feeder cable 23 is soldered to the outer surface of the conductive tube 22. Braided shielding wire 23*b* of the coaxial feeder cable 23 is connected to an extended end 24*c* of a grounding conductor 24** via a connector.

End portions **24*a* and 24*b* of the grounding conductor 24 installed in the housing tube 20 are parallel to the attachment surface of the attachment base 25 which is inclined at a predetermined angle relative to an axis of the antenna element 11. Thus, when the housing tube 20 is mounted on the vehicle body, the end portions 24*a* and 24*b* of the grounding conductor 24 are positioned parallel to the vehicle body wall (not shown). The end portions 24*a* and 24*b*** serve as a grounding element for the antenna when they are connected to the vehicle body wall via screws.

The telescopic antenna 10 is installed in the housing tube 20 mounted to the vehicle body wall as follows:

The rod-form antenna element 11, which has the cap 16 on its upper end, the ring 14 at the lower end, the fastening element 12 and the conductive contact spring 13, is inserted into the housing tube 20 from the outside of the vehicle. Then, the fastening element 12 is screwed to the conductive tube 21 which is provided inside the antenna insertion hole of the housing tube 20.

As a result of the fastening element 12 being screwed in the conductive tube 21, the lower end of the fastening element 12 presses an upper end flange **13*a* of the conductive contact spring 13 against a step portion of the conductive tube 21. Thus, the conductive contact spring 13 is fixedly installed inside the antenna insertion hole with the outside surface thereof pressed against the inner surface of the conductive tube 22. Thus, the rod-form antenna element 11** can slide freely inside the antenna insertion hole so as to be extended and retracted but is prevented from slipping out of the antenna insertion hole.

More specifically, when the rod-form antenna element 11 is extended, each rod is drawn outward until the largest-diameter rod reaches its limit of extension. At this point, the ring 14 which acts as a locking projection strikes against a lower end **13*b* of the conductive contact spring 13. Accordingly, in this position, extension movement of the rod-form antenna element 11 is halted, and the rod-form antenna element 11** is prevented from falling out of the vehicle body (that is, prevented from slipping out of the antenna insertion hole).

Thus, as a result of the fastening element 12 being screwed in, the rod-form antenna element 11 is allowed to freely slide inside the antenna insertion hole during extension and retraction thereof, while locking is simultaneously achieved via the ring 14 so that the rod-form antenna element 11 is prevented from falling out of the vehicle body.

The rod-form antenna element 11 is removed from the housing tube 20 mounted to the vehicle body wall as follows:

When the rod-form antenna element 11 breaks, for example, and it is necessary to replace it, the fastening element 12 is first unscrewed from the conductive tube 21. The rod-form antenna element 11 is then pulled out of the antenna insertion hole. In other words, the rod form antenna element 11 is taken out of the housing tube 20 with the fastening element 12 and conductive contact spring 13 caught thereon by the ring 14.

The fastening element 12 is removed from antenna element or the largest-diameter rod in the following manner and is to be reused:

If the diameter of the cap 16 is smaller than the diameter of the largest-diameter rod (and therefore the inner diameter of the fastening element 12 is larger than the cap 16), the fastening element 12 is able to pass over the cap 16. Thus, the fastening element 12 is removed from the tip end of the antenna element 11 by moving it in the direction of arrow A in FIG. 2.

If the diameter of the cap 16 is larger than the diameter of the largest-diameter rod (and therefore the inner diameter of the fastening element 12 is smaller than the cap 16) as shown in FIG. 1, the fastening element 12 is unable to pass over the cap 16. In this case, the ring 14 is first removed from the antenna element 11. This allows the fastening element 12 to move in the direction of the arrow B, so that the fastening element 12 is removed from the base end of the antenna element 11 along with the conductive contact spring 13. In other words, since the ring 14, which is used as a locking projection, is attached at the base end of the rod-form antenna element 11 via the screw 15 so as to be removed, the fastening element 12 can easily be removed from the base end of the rod-form antenna element 11 after removing the ring 14 from the base end of the antenna element 11.

Thus, even if the diameter of the cap 16 is larger than the diameter of the largest-diameter rod of the antenna element 11 (and therefore is larger than the fastening element 12), the fastening element 12 can easily be removed from the rod-form antenna element 11 and reused.

The present invention is not limited to the embodiment described above. It goes without saying that various modifications may be made without departing from the spirit of the present invention.

As described in detail in the above, according to the present invention, the locking projection for preventing the antenna from slipping out of the antenna housing tube is attached to the base end of the rod-form antenna element via, for example, screws, so that it may be removed. Accordingly, the fastening element for fastening the antenna to the antenna housing tube can easily be removed from the antenna element and reused even in cases where the diameter of the cap at the tip end of the smallest-diameter rod of the rod-form antenna element is larger than the diameter of the largest-diameter rod of the rod-form antenna element.

I claim:

1. A telescopic antenna for use in motor vehicles comprising:

an antenna housing tube having a longitudinally extending hole therethrough;

an attachment base coupled to said housing tube;

a cylindrical conductive contact spring inserted in said longitudinally extending hole;

a rod form telescopic antenna element extending through said cylindrical conductive contact spring;

a fastening element coupled to one end of said longitudinally extending hole for preventing said cylindrical conductive contact spring from being pulled out of said antenna housing tube;

a decorative cap provided on one end of said antenna element which extends out of said fastening element; and a locking projection detachably provided on another end of said antenna element for preventing said antenna element from being pulled out of said contact spring.

2. A telescopic antenna according to claim 1 wherein said attachment base and said antenna housing tube are coupled together with some predetermined angle therebetween.

3. A telescopic antenna according to claim 2 wherein said antenna housing tube and attachment base are integrally molded from an insulating material.

* * * * *